US005954476A

United States Patent [19]

Stewart et al.

[11] Patent Number: 5,954,476

[45] Date of Patent: Sep. 21, 1999

[54] SNAP-FIT BLOWER HOUSING ASSEMBLY AND SEAL METHOD

[75] Inventors: Dale Stewart, Aurora; William S. Gatley, Cassville, both of Mo.

[73] Assignee: Fasco Industries, Inc., Chesterfield, Mo.

[21] Appl. No.: 08/909,595

[22] Filed: Aug. 12, 1997

[51] Int. Cl.[6] ..... F04D 29/40

[52] U.S. Cl. ..... 415/214.1; 415/203; 403/334

[58] Field of Search ..... 415/214.1, 203, 415/204, 206; 29/463, 453; 403/334, 343

[56] References Cited

U.S. PATENT DOCUMENTS 2,958,230 11/1960 Haroldson ..... 29/453
3,627,442 12/1971 Brandt .
3,707,335 12/1972 Barnard ..... 415/204
4,865,517 9/1989 Beehler .
5,029,878 7/1991 Ray ..... 277/170
5,158,432 10/1992 Cox .
5,283,939 2/1994 Saunders et al. ..... 29/453
5,443,364 8/1995 Mistry .

*Primary Examiner*—F. Daniel Lopez
*Assistant Examiner*—Richard Woo
*Attorney, Agent, or Firm*—Lorusso & Loud

[57] ABSTRACT

A blower housing body is disclosed comprising a housing body and housing cover. The housing body and housing cover are provided with mating surfaces that provide the ability to releasably lock the housing cover to the housing body to allow ease of disassembly for basic maintenance and re-assembly for continued use. The locking mechanism is accomplished by a ridge formed on the top of a side wall of the housing body and a corresponding channel in the housing cover.

11 Claims, 10 Drawing Sheets

SNAP-FIT BLOWER HOUSING ASSEMBLY AND SEAL METHOD

BACKGROUND OF THE INVENTION (1) Field of the Invention

This invention relates generally to draft inducers for furnaces. More particularly, the present invention relates to blower housings and the assembly of such housings.

(2) Description of Related Art

Prior methods used to join blower housings have included everything from spot welding, seam welding, joining with mechanical fasteners or retainer clips. More recent methods have been made possible by the advent of plastics engineered to withstand forces such as impact or more relevantly, the force imparted to a plastic blower housing by an inducer.

For example, U.S. Pat. No. 3,627,442 to Brandt discloses a blower housing made from three pieces of preformed sheet metal. Two end walls are provided along with a scroll-shaped wall that is situated between the end walls. The three pieces are joined by mechanical fasteners that are inserted into apertures in the end walls that align with threaded, thread-engaging apertures formed in the scroll-shaped wall. This type of housing structure requires a significant amount of machining as well as a considerable number of steps to assemble or disassemble the blower housing to service the blower. Moreover, it is easy to impart an uneven pressure to the seal at various points along the seal due to variations in the tightening of the fasteners.

An improvement to the blower housing assembly disclosed in the '442 patent is taught in U.S. Pat. No. 5,158,432 to Cox. The '432 patent teaches a tab and slot sheet metal joining technique wherein tabs situated on the scroll-shaped wall are inserted into apertures in the end walls. Thereafter, the tabs are rolled or folded to interlock the parts. Although a secure joint can be established, the parts cannot be easily disassembled without considerable effort. Furthermore, the parts cannot be repeatedly cycled through assembly, disassembly and re-assembly without damaging the tabs through the process of metal fatigue.

A further improvement made possible by the advent of durable plastic materials is disclosed in U.S. Pat. No. 4,865,517 to Beehler. In the '517 patent, a blower housing is assembled from two mating clam shell-like halves. Each half has a circumferential groove situated on an exterior surface adjacent to the half's periphery. The shell halves are held together with preformed spring steel clips that engage the circumferential grooves of the shell halves. The clips coupled with a tongue and groove joint and optional gasket provide an air tight seal along with the ability to readily disassemble the housing to service the enclosed impeller. However, due to the use of the steel clips, corrosion is still a factor especially when the blower is used in a heating furnace in which moisture develops.

Apart from using any type of mechanical fasteners, some manufacturers have used adhesives to secure an end wall cover to a blower housing. This eliminates the ability to service the enclosed impeller by removing the cover. Inevitably, some damage will occur if the cover is forcibly removed from the blower housing.

Another approach used to secure parts of a blower housing is disclosed in U.S. Pat. No. 5,443,364 to Mistry et al. The '364 patent teaches a blower housing with the scroll-shaped wall and one end wall being fabricated as one piece. The other end wall is separate and serves the function of a housing cover. The housing cover is secured to the blower housing with a series of unique tab-aperture combinations. A series of radially extending tabs are formed on the cover. Flexible arms that extend from the blower housing are formed with barbed detents at the distal ends. To secure the cover to the housing, the cover and housing are aligned so that the flexible arms match up with the apertures. The two parts are then compressed together so that the barbed arms snap into the apertures. A seal is created between the parts by virtue of a top circumferential edge of the housing that is mated to a circumferential channel in an interior side of the cover. Although this design provides a snap-on type seal, the design of the flexible arms are prone to deformation or breaking and are relatively fragile due to their small size. Inevitably, the same pressure cannot be imparted at every point along the seal due to the spacing of the flexible arms.

Although numerous designs have been developed to seal blower housings none to date have the capability to provide a corrosion-free housing that is easy and cost-effective to manufacture such that a strong even pressure seal is provided along with the ability to provide ease of assembly and disassembly as well as the ability to withstand cycles of assembly and re-assembly without any appreciable damage to the joining surfaces. A way to provide all these advantages has now been developed.

SUMMARY OF THE INVENTION

It is, therefore, an object of the present invention to provide a blower housing assembly that can be assembled without the need for any mechanical fasteners. Thereby, the need for bolts, screws or spring clamps is obviated.

Another object of the present invention is to provide a uniform seal that maintains an air-tight seal through blower operation.

A further object of the present invention is to provide a releasably locking seal that tightens when pressure is applied to the blower cover from the inlet port in an attempt to remove the cover from the blower housing main body.

A still further object of the present invention is to provide a cost-effective blower housing that is easy to manufacture and requires no additional parts beyond a housing body and a housing cover.

The blower housing assembly described herein includes a housing body and a housing cover. The housing body has a side wall with a ridge extending axially therefrom. A radially exterior wall of the ridge has an apex either at the midpoint or at some other point between the two ends of the exterior wall that extends radially outwardly from the ridge.

The housing cover has a side wall with portions that define a channel. A radially external wall of the channel has a portion, distal from the plane occupied by a bottom face of the housing cover, that slopes radially inwardly from a point between the two ends of the radially external wall to the distal end of said wall. The length of at least one wall of the channel has a length that is at least as long as the height of the ridge of the housing body side wall. In a preferred embodiment, the length of at least one wall of the channel is longer than the height of the ridge so that an air gap or cavity is formed in the channel when the housing cover is mated to the housing body.

The mating surfaces of the housing body and housing cover provide a means to releasably lock the parts together to form a blower housing. The mating surfaces of the housing body and housing cover, when joined, provide an essentially airtight seal that can be enhanced, if desired, with a gasket placed in the channel in the air gap portion of the channel that is formed when the housing body is mated with the housing cover.

To combine the housing body and housing cover, guide pins are provided on the perimeter of the housing cover that correspond to pin holes in the housing body. To join the parts, the guide pins are inserted into the pin holes to align the housing body and housing cover, and pressure is exerted against the cover on the perimeter so that the side wall of the housing cover deflects to allow the sloping section of the radially external wall of the channel to slip past the apex of the ridge of the housing body side wall. After the sloping section passes the apex, the housing cover side wall re-deflects into its initial position so that the sloping section impinges against the apex and prevents the housing cover from being removed from the housing body without the use of force.

To separate the housing body from the housing cover, a striking object is used, such as a hammer, to strike the guide pins of the housing cover. When the guide pins are struck with sufficient force, the side wall of the housing cover deflects to allow the sloping section of the radially external channel wall to slide past the ridge apex of the housing body side wall thus releasing the housing cover from the housing body.

The blower housing parts are made of a material such as an engineering grade of plastic that has sufficient elasticity to allow the side wall of the housing cover to deflect and re-deflect cyclically to allow disassembly and reassembly of the blower housing.

DESCRIPTION OF THE PREFERRED EMBODIMENTS

A high efficiency furnace typically includes a combustion air inlet, a combustion chamber, a heat recovery section, a draft inducer and a combustion gas exhaust. When the furnace is in operation, the draft inducer or combustion blower creates a negative pressure or induces a draft in the furnace so air for combustion is drawn into the air inlet and then into the combustion chamber, where the air is mixed with a fuel such as natural gas for combustion or burning (i.e., the heat energy source). The heat energy of the combustion process is then extracted from the combustion or exhaust gases in the heat recovery section which also results in a reduction in the temperature of the combustion gases. For high efficiency furnaces, heat recovery is generally accomplished in two stages.

After passing through the heat recovery section of the furnace, the relatively cooler combustion gases are drawn into the draft inducer or combustion blower by the rotation of the impeller or rotating blades within the draft inducer. The rotation of the impeller or rotating blades of the blower creates the draft which draws the air for combustion into the furnace and which draws the combustion gases through the furnace and the heat recovery sections. The combustion gases are then exhausted by the draft inducer through an exhaust pipe out to the atmosphere.

To provide an even, efficient flow of gases, it is important that the housing for the draft inducer be adequately sealed so the vacuum effect created by the rotation of the impeller is put into effect to draw gases into the inducer at an inlet and to expel gases at an outlet. Any leaks in the housing will inevitably lead to the inefficient and incomplete removal of combustion gases.

Because the impeller and motor assembly, contained within the inducer housing, is subject to wear and tear, it is equally important to be able to access these parts for maintenance without having to provide a new housing after repair of the internal blower components.

Figure 1:
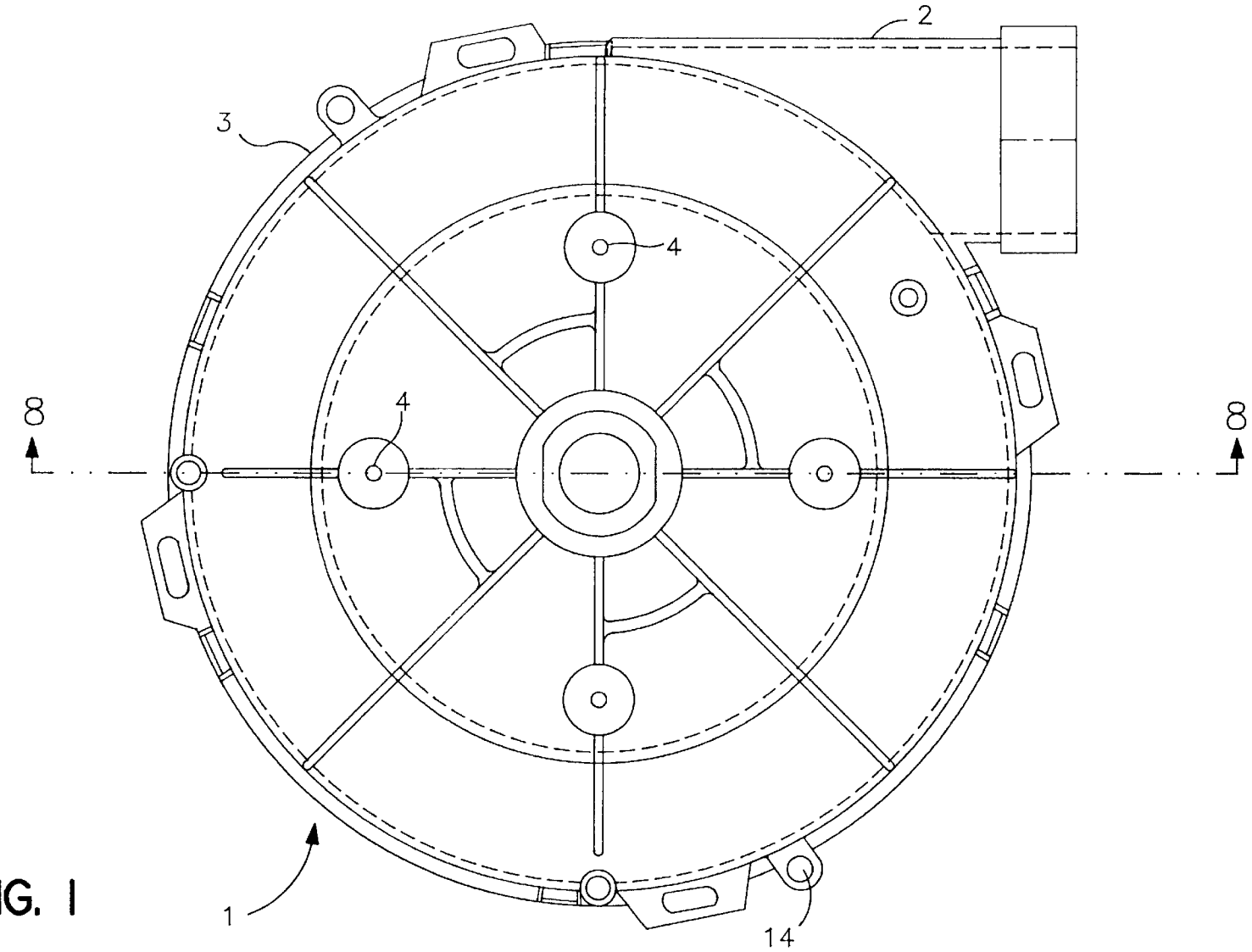
FIG. 1 is a top view of the housing body of one embodiment of the invention.

To accomplish these goals, a new blower housing construction has been devised wherein the housing, comprising a housing body and housing cover, can be releasably locked. Turning to FIG. 1, an exterior view of a housing body 1 of one embodiment of the present invention is shown wherein the perimeter of housing body 1 is essentially circular in shape with an exhaust port 2 extending tangentially from a side arcuate wall 3 of the housing body 1. The exhaust port 2 is in fluid communication with an internal area of the housing body (not shown). Apertures 4 are provided in the housing body to provide a means to secure the housing to a fan motor unit (not shown) with mechanical fasteners such as bolts (not shown). Housing body 1 also has pin holes 14 used in conjunction with guide pins 13 (shown in FIG. 6 and more fully described below) for aligning housing body 1 with a housing cover 9 (shown in FIGS. 4 and 5).

Although the housing body 1 is shown in FIG. 1 as being essentially circular in shape, the housing body 1 can be a variety of shapes to accommodate an impeller unit contained in the housing unit that is used to expel air and gases passing into the blower housing. A housing shape that has been used successfully, apart from the circular shape shown in FIG. 1, is a scroll-shaped housing. Ultimately, the housing body shape is a design consideration that can vary with the impeller used and the use to be made of the blower unit of which the blower housing is a part.

Figure 2:
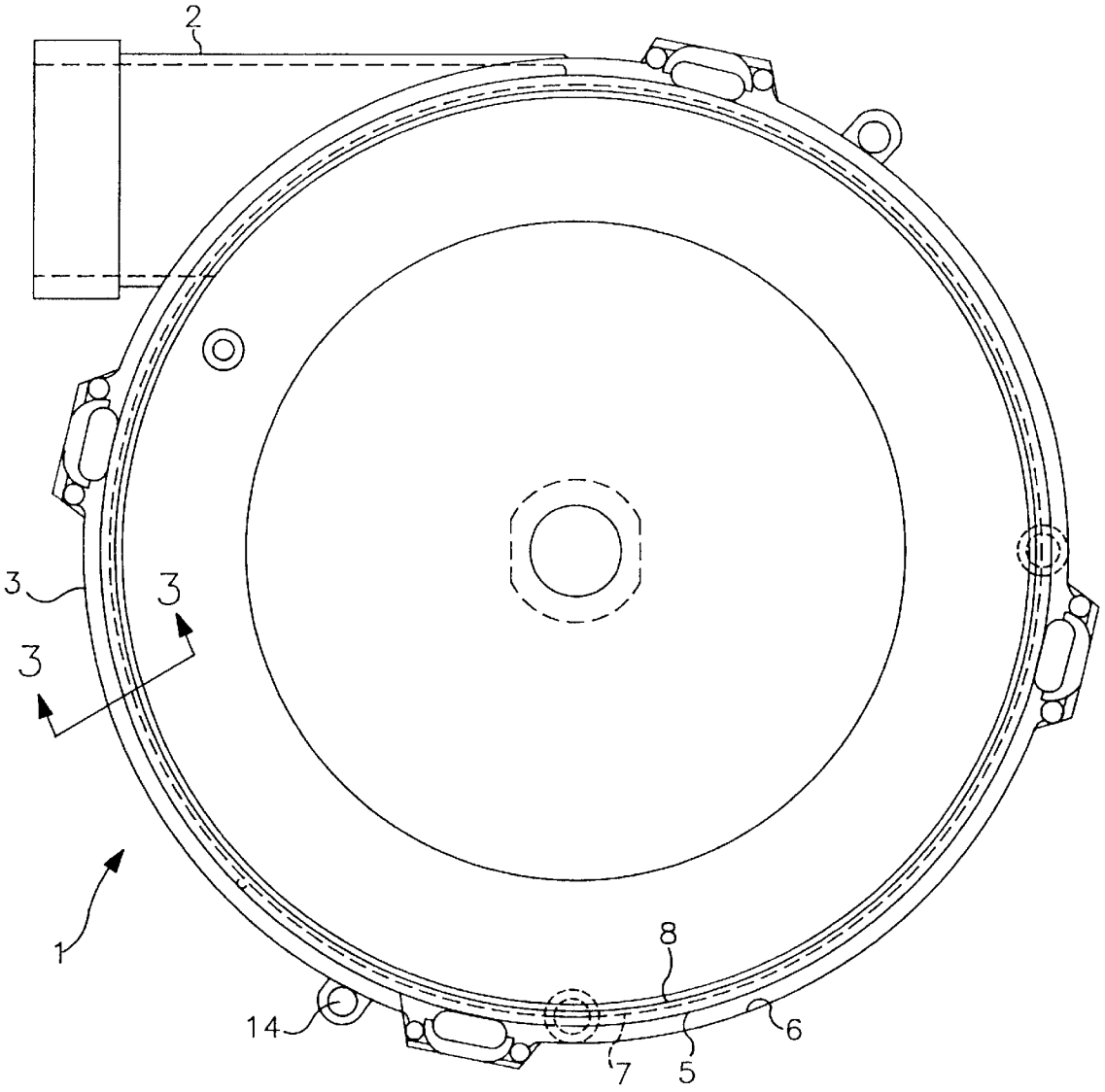
FIG. 2 is a bottom view of the housing body of one embodiment of the invention.

Turning to FIG. 2, an interior view of the housing body 1 is shown wherein the side arcuate wall 3 has an axially extending ridge 5 extending from a top edge 6 of said side arcuate wall 3. The ridge 5 is essentially rectangular or square in shape except that a midpoint of an interior ridge wall 7 (dotted line) of ridge 5 extends radially inwardly to create an apex 8 along the length of interior ridge wall 7.

Figure 3:
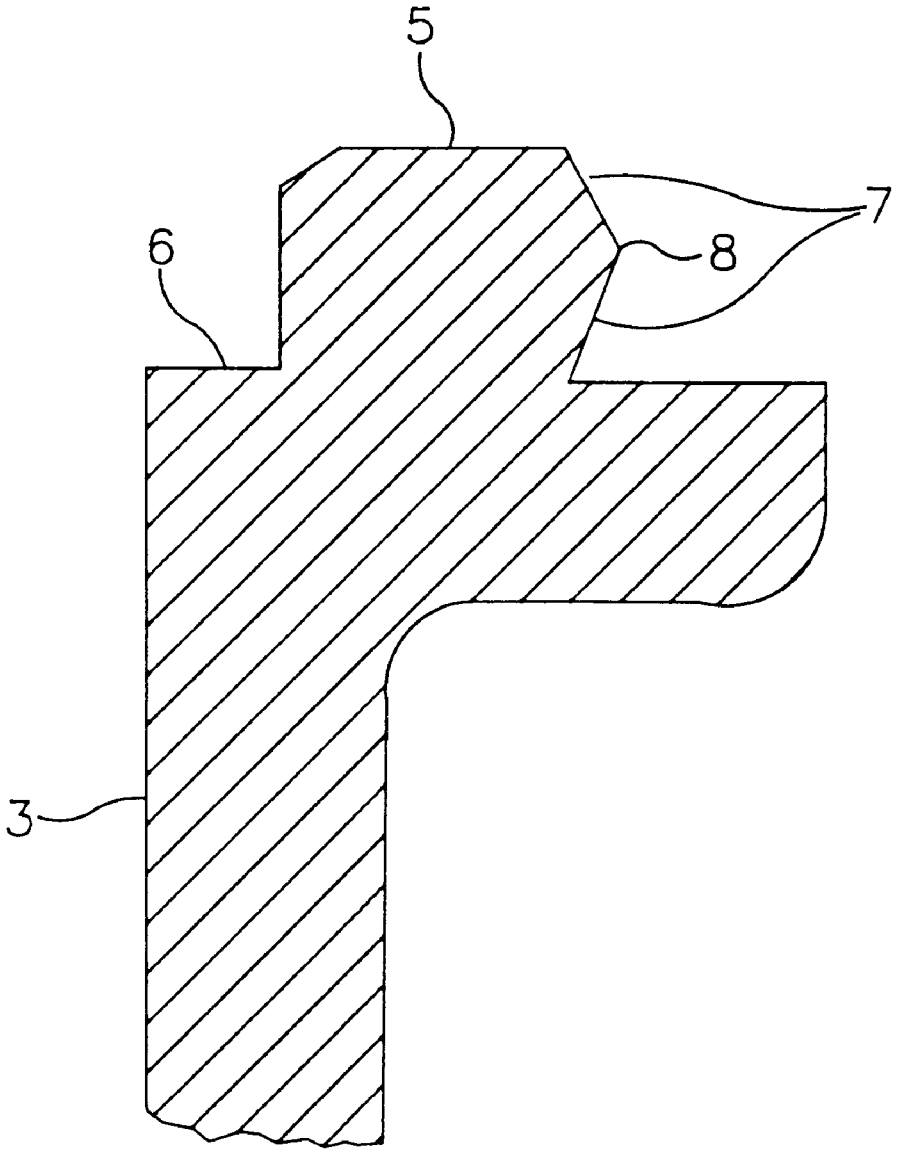
FIG. 3 is a cross-sectional elevational view of a housing body side wall and ridge element of one embodiment of the invention.

Referring to FIG. 3, a cross-sectional elevational view of arcuate wall 3 is shown. In this view, ridge 5 can be seen extending upwardly from top edge 6 which is the axial direction of the housing body 1 as shown in FIG. 2. Apex 8 can be seen extending radially inwardly from the midpoint of interior ridge wall 7. In practice, apex 8 can be situated at any point between the top and bottom edges of interior ridge wall 7.

Figure 4:
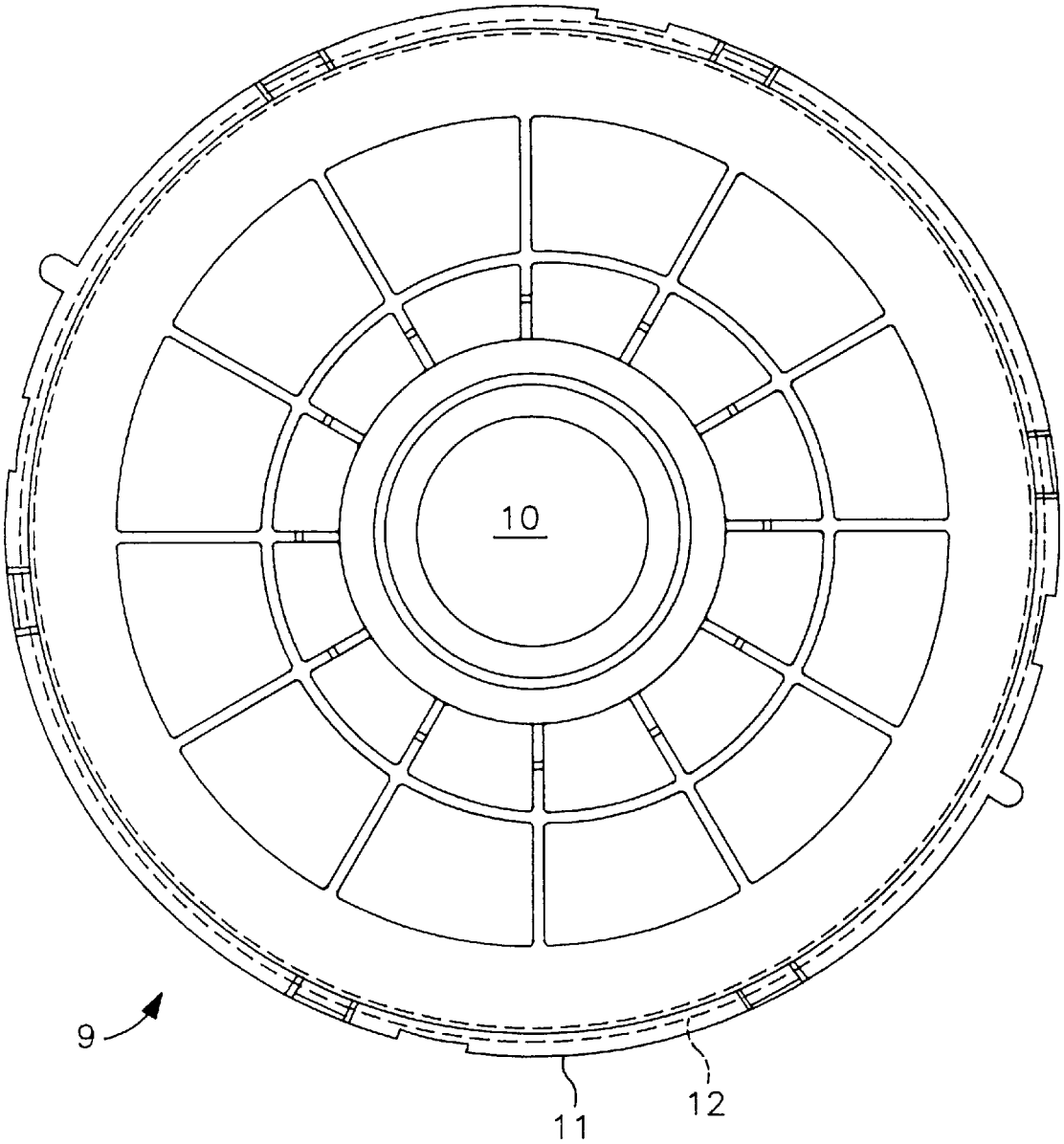
FIG. 4 is a top view of the housing cover of one embodiment of the invention.
Figure 5:
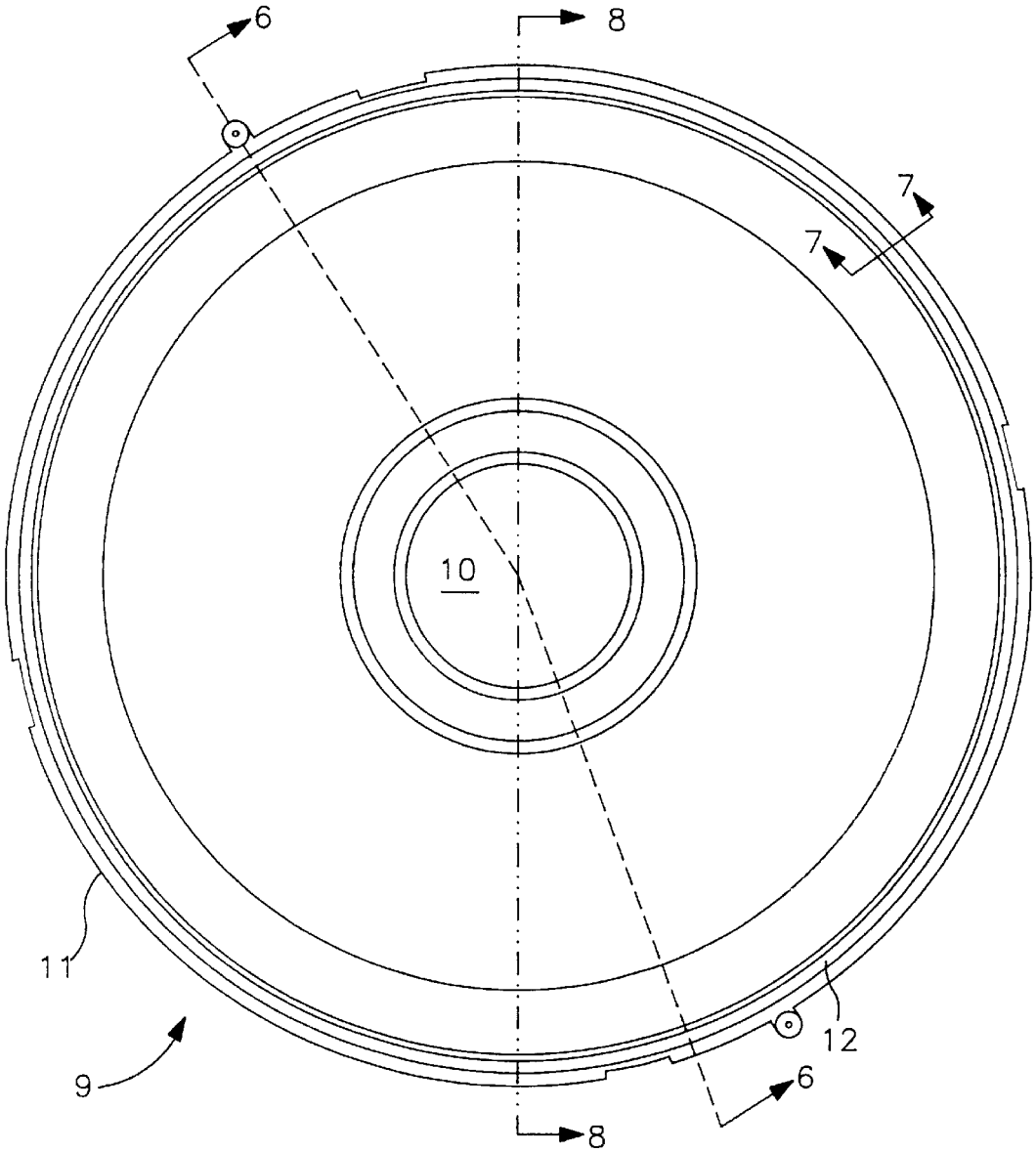
FIG. 5 is a bottom view of the housing cover of one embodiment of the invention.
Figure 6:
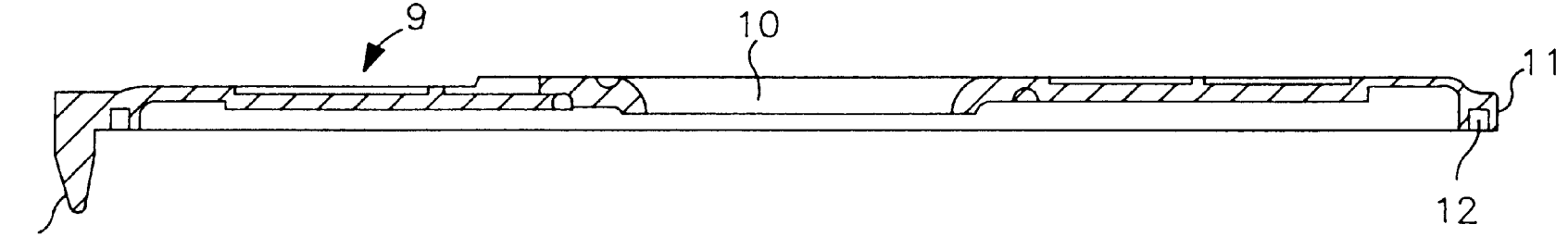
FIG. 6 is a cross-sectional view of the housing cover of one embodiment of the invention.

Referring to FIGS. 4, 5 and 6, top, bottom and cross-sectional views of housing cover 9 are shown, respectively, wherein the perimeter shape of housing cover 9 is shaped to conform to, and matingly engage, housing body 1. In practice, the perimeter shape of housing cover 9 is dictated by the shape given to housing body 1. Any limitation to the perimeter shape of housing body 1 will also necessarily apply to housing cover 9.

In one embodiment, an aperture 10 is provided concentric with a perimeter of housing cover 9 to provide an inlet for gases drawn into the blower housing by an enclosed impeller (not shown). A housing cover side wall 11 is provided which extends axially from a perimeter of a bottom face of housing cover 9. Housing cover side wall 11 has portions which define a channel 12 (dotted line) which opens axially from the bottom face of housing cover 9.

Referring to FIG. 6, a guide pin 13 is provided to provide a means to align housing cover 9 with corresponding pin holes 14 of housing body 1. The combination of pins 13 and pin holes 14 allow for the precise alignment of housing body 1 and housing cover 9 so that the mating surfaces of ridge 5 and channel 12 can be effectively engaged to releasably lock together housing body 1 and housing cover 9.

Figure 7:
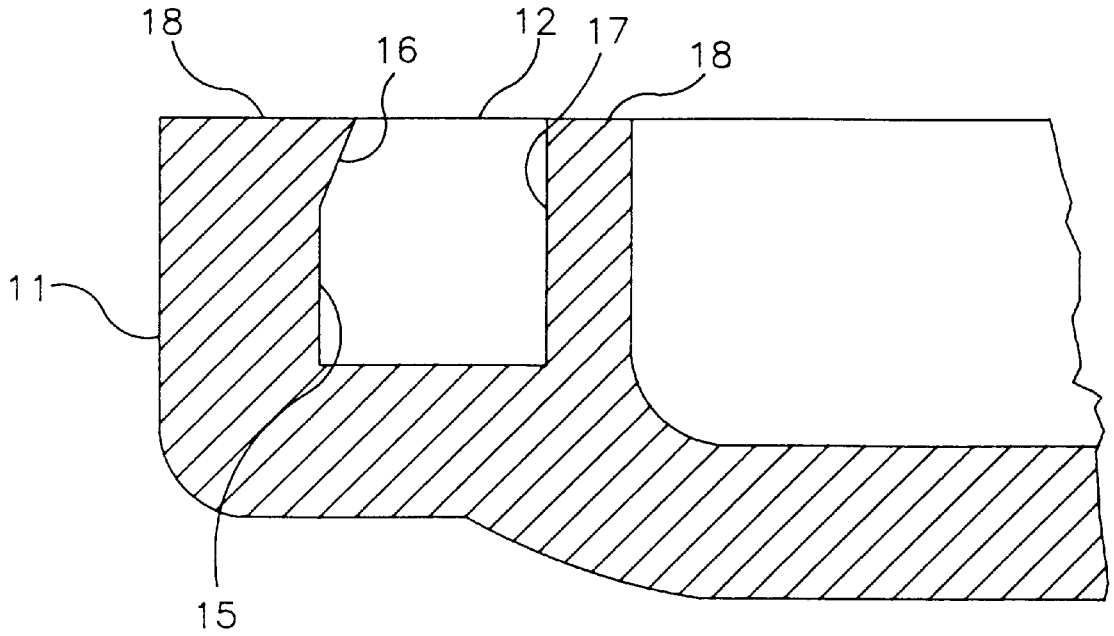
FIG. 7 is a cross-sectional view of a housing cover side wall and channel contained therein.

Turning to FIG. 7, a cross-sectional view of channel 12 is shown wherein a radially exterior wall 15 of channel 12 has a radially-inwardly sloping section 16 which slopes into the cavity of channel 12 at an end of wall 15 distal from the bottom face of housing cover 9. Preferably, section 16 forms an angle with the remainder of wall 15 such that the angle formed conforms to the angle formed by apex 8 and ridge wall 7.

Channel 12 has a radially interior wall 17 which is preferably essentially perpendicular to the plane occupied by the bottom face of housing cover 9. However, the relative angle of wall 17 to the bottom face of housing cover 9 can be altered to accommodate the corresponding angle of the walls of ridge 5.

Housing cover side wall 11 has bottom edges 18 which contact top edge 6 of side arcuate wall 3 when housing body 1 is assembled with housing cover 9. Contact of these edges provides part of the essentially airtight seal. The walls of ridge 5 and channel 12 provide the rest of the parts that contribute to the seal.

Figure 8:
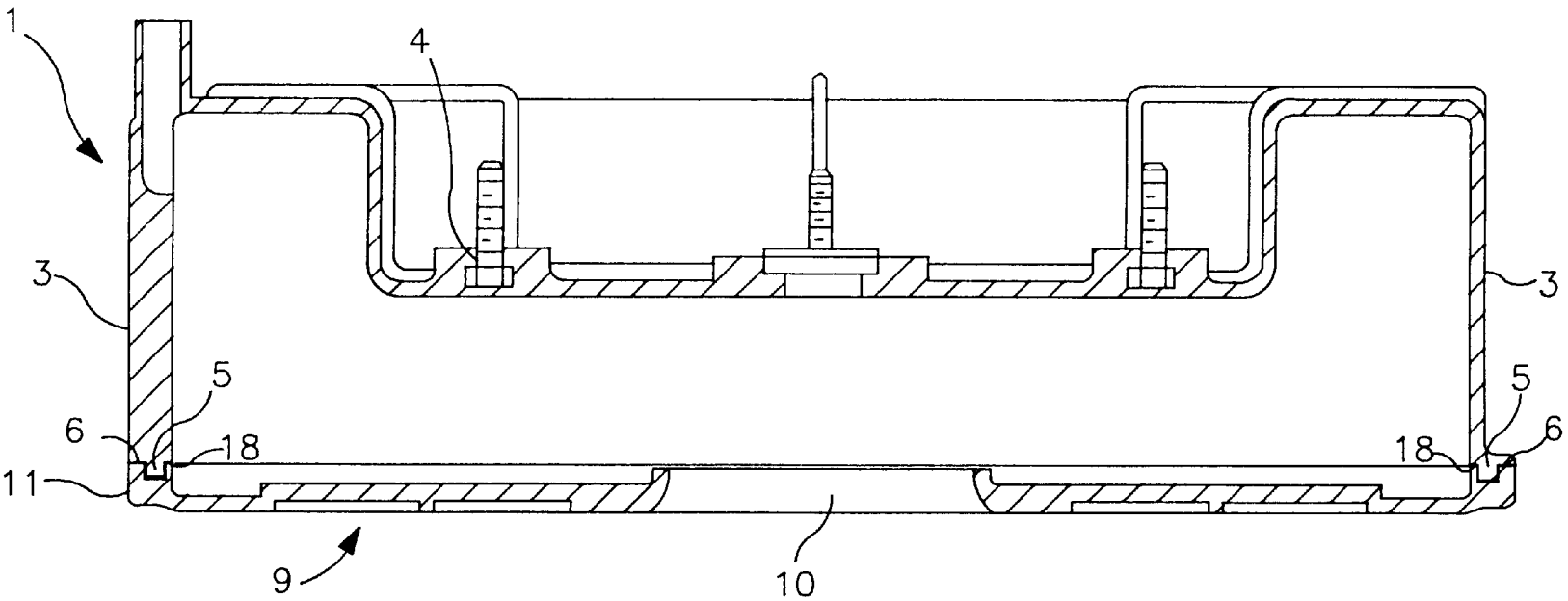
FIG. 8 is a cross-sectional elevational view of the blower housing assembly according to one embodiment of the invention.

Referring to FIG. 8, a cross-sectional elevational view of an assembled blower housing comprising housing body 1 and housing cover 9 is shown. As can be seen, the mating surfaces of ridge 5 and channel 12 engage so that an airtight seal is created.

Figure 9:
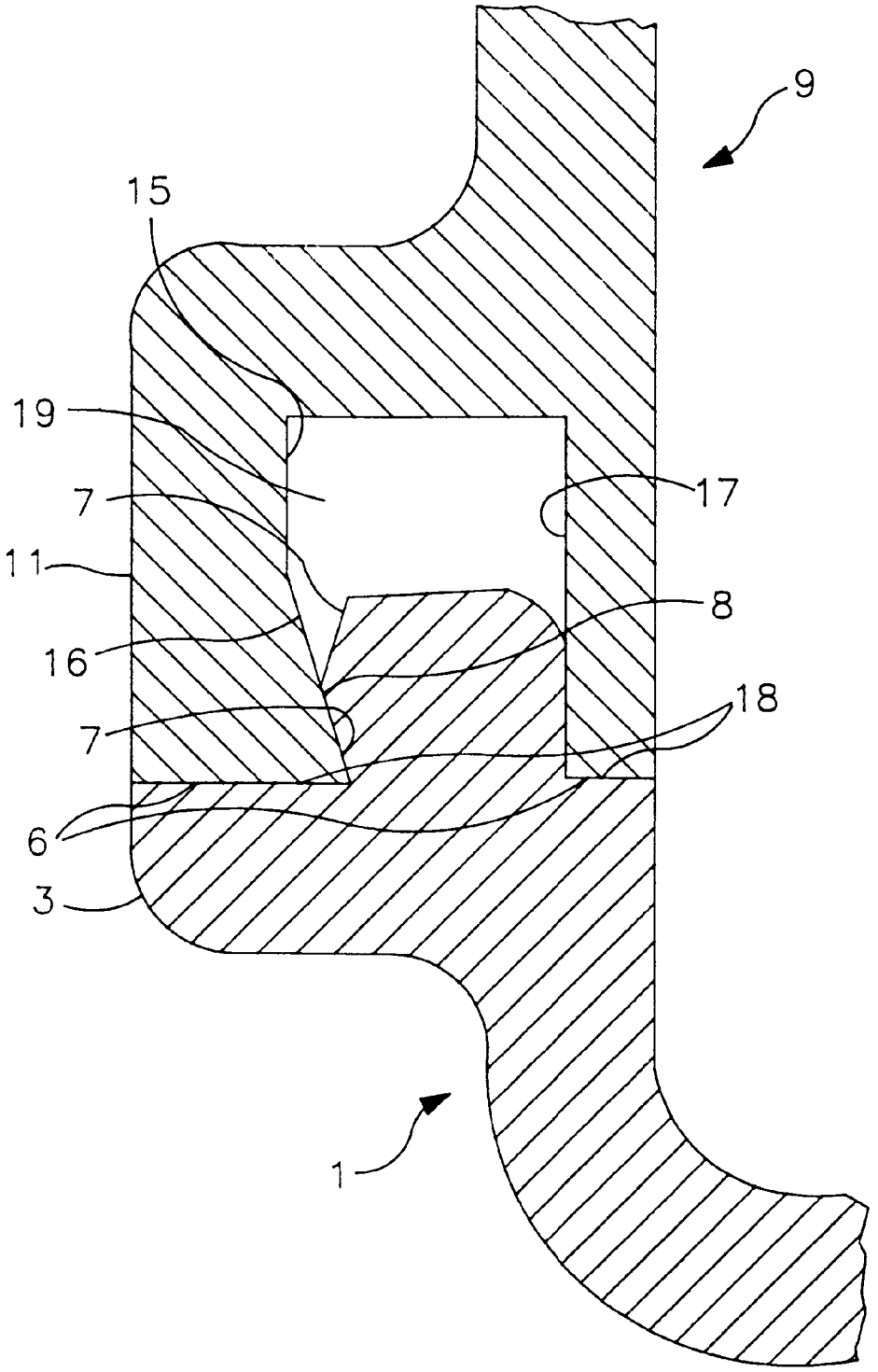
FIG. 9 is a cross-sectional elevational view of the ridge and channel sections of the housing body and housing cover, respectively.
Figure 9A:
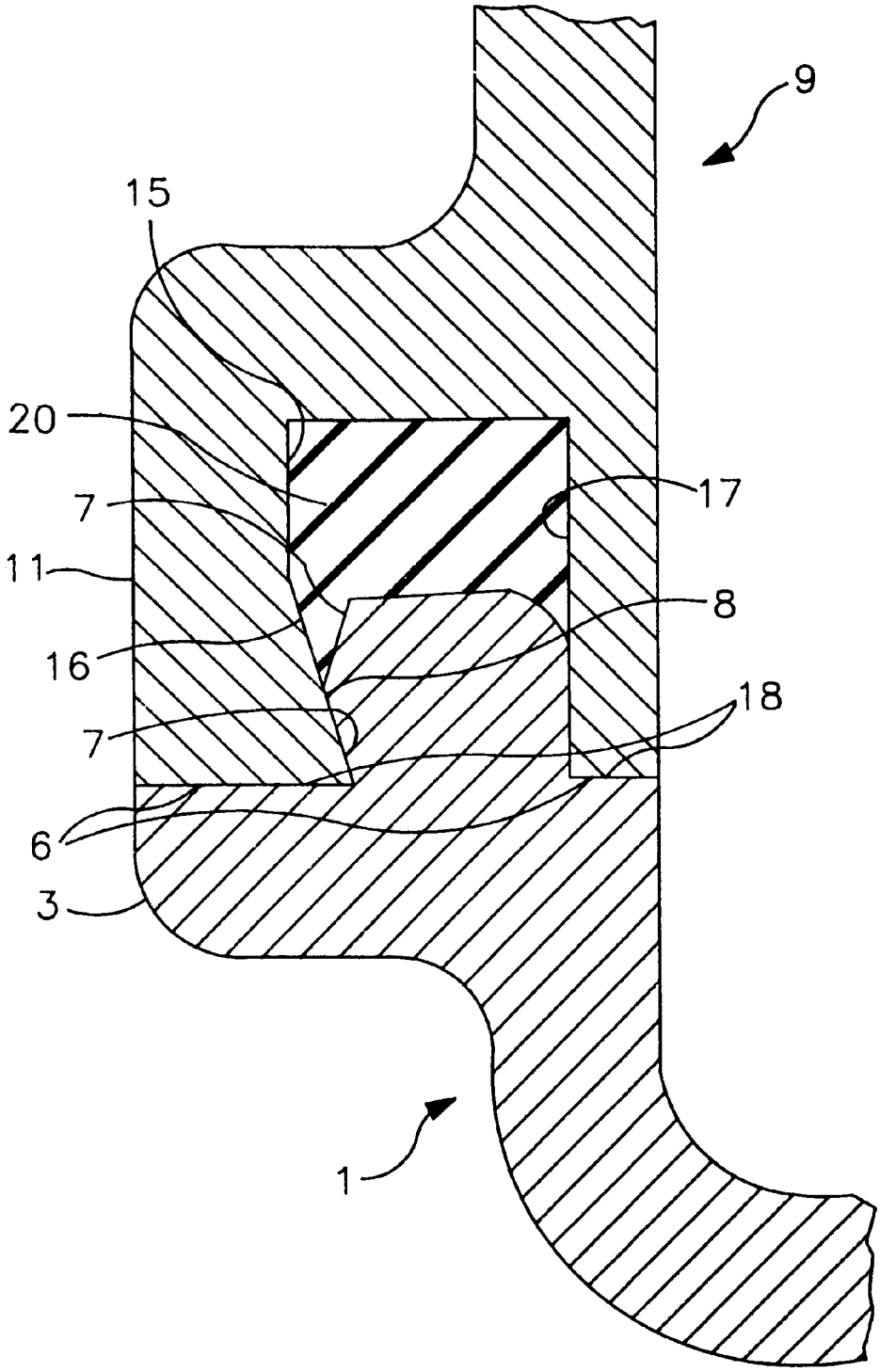
FIG. 9*a* is a cross-sectional elevational view of the arcuate ridge and channel sections of the housing body, housing cover and gasket assembly.

The interaction of the surfaces of ridge 5 and channel 12 can be seen more clearly in FIG. 9. The combination of the corresponding angles formed by apex 8 and section 16 of wall 15 releasably lock housing body 1 to housing cover 9 to provide an essentially airtight seal by virtue of the mating surfaces, top edge 6 of housing body side wall 3 and bottom edges 18 of housing cover side wall 11.

In a preferred embodiment, interior wall 17 of channel 12 is longer than the height of ridge 5 so that an air cavity 19 is formed between ridge 5 and the bottom of channel 12. Although the locking structure shown in the drawings is sufficient to provide an essentially airtight seal, if desired, a gasket 20 can be inserted into the air cavity 19 to provide additional means to seal off the interior of the blower housing from the exterior with the exception of aperture 10.

To assemble the housing assembly of the present invention, the guide pins 13 of housing cover 9 are inserted into pin holes 14 of housing body 1. Pressure is then exerted over the perimeter edges of housing cover 9 which is pressed down onto housing body 1. The bevel formed by ridge wall 7 and apex 8 combined with the internally directed section 16 of channel exterior wall 15 cause housing cover side wall 11 to deflect to allow the juncture of bottom edge 18 and section 16 to slide past apex 8. After bottom edge 18 slides past apex 8, side wall 11 re-deflects to its initial position before engagement of section 16 with apex 8.

An unexpected advantage of the present locking system is that when housing top 9 is pulled away from housing body 1 by grasping housing top 9 through aperture 10, the deformation of the body of housing cover 9 causes section 16 to press against apex 8 of ridge wall 7 with increasing force thereby increasing the locking mechanism of the mating surfaces. This approach to removing housing cover 9 from housing body 1 is only successful when an extremely large force is used to pull housing cover 9 up via grasping at aperture 10. A more effective means of removing cover 9 is to use a hammer and apply a quick strike to guide pins 13 while holding housing body 1.

Depending on the material used to make the blower assembly components, the present invention provides a means for locking a housing cover to a blower housing body such that an essentially airtight seal is provided even after many cycles of locking and removing the cover from the housing body for purposes such as maintenance of the enclosed impeller unit.

Preferably, the described components of the blower assembly are made from an engineering grade of plastic to provide the strength and elasticity needed for the deflection and re-deflection of side wall 11 of housing cover 9. However other suitable materials may be used such as steel so long as the material is designed to provide the requisite flexibility in side wall 11.

It is to be understood that the present invention is by no means limited to the particular constructions herein disclosed and/or shown in the drawings, but also comprises any modifications or equivalents within the scope of the claims, e.g., placing the ridge on the housing cover side wall and the channel in the housing body side wall.

Having thus described our invention, what we claim as new and desire to secure by United States Letters Patent is:

1. A releasably locking blower housing assembly, comprising:

a housing body having a housing body side wall, wherein portions of said housing body side wall form a ridge on a top edge of said housing body side wall and, wherein said ridge has a radially external wall having an apex, located between the two ends of said radially external wall, said apex extending radially outwardly from said ridge; and, a housing cover having a housing cover side wall that has portions that matingly engage portions of said housing body side wall.

2. The blower housing assembly of claim 1 wherein said portions of said housing cover side wall form a channel in said housing cover side wall.

3. The blower housing assembly of claim 2 wherein said channel has a radially external channel wall that has a sloping section that slopes radially inwardly into said channel from a point between the two ends of said radially external channel wall toward the end of said radially external channel wall that is distal to a plane occupied by a bottom face of said housing cover.

4. The blower housing channel of claim 3 wherein at least one wall of said channel is longer than said ridge of said housing body side wall such that when said housing body is matingly joined with said housing cover, an air cavity is formed in said channel.

5. The blower housing assembly of claim 2 wherein said channel has a gasket situated therein.

6. A blower housing assembly, comprising:

a housing body with a side wall having a ridge extending from a top surface of said side wall, said ridge having a radially external ridge wall with an apex located between the two ends of said radially external ridge wall, said apex extending radially outwardly from said ridge; and a housing cover with a side wall having portions defining a channel wherein a radially external channel wall of said channel has a sloping section that slopes radially inwardly into said channel from a point between the two ends of said radially external channel wall toward the end of said radially external channel wall that is distal to a plane occupied by a bottom face of said housing cover, said channel having walls that matingly engage walls of said housing body ridge.

7. The blower housing assembly of claim 6 wherein said channel has a gasket situated therein.

8. A method of releasably locking a blower housing assembly comprising the steps of:

providing a housing body with a housing body side wall having a ridge extending from said housing body side wall, wherein said ridge has a radially external wall having an apex, located between the two ends of said radially external wall, said apex extending radially outwardly from said ridge;

providing a housing cover with a side wall having portions defining a channel that is matingly engageable with said ridge of said housing body side wall;

placing said housing cover on said housing body such that said ridge on said housing body side wall and said channel in said housing cover side wall are in alignment;

placing pressure on said housing cover so that said ridge and said channel matingly engage.

9. The method of assembly of claim 8 including the additional steps of providing a gasket; and placing said gasket into said channel before said step of placing said housing cover on said housing body.

10. The method of assembly of claim 8 wherein said housing body has at least one pin hole and said housing cover has at least one guide pin;

aligning said at least one guide pin with said at least one pin hole; and, inserting said guide pin in said pin hole to align said housing cover with said body before said step of placing pressure on said housing cover.

11. The method of assembly of claim 10 including the additional steps of:

providing a gasket; and placing said gasket into said channel before said step of placing said housing cover on said housing body.

* * * * *